US009510664B2

(12) United States Patent
Wen et al.

(10) Patent No.: US 9,510,664 B2
(45) Date of Patent: Dec. 6, 2016

(54) TOOTHBRUSH HAVING AN INNER CAVITY

(71) Applicant: The Procter & Gamble Company, Cincinnati, OH (US)

(72) Inventors: Li Wen, Mason, OH (US); Matthew Lloyd Newman, Mason, OH (US); Andreas Birk, Kronberg (DE); Andreas Bresselschmidt, Kronberg (DE); Andrew Joseph Horton, West Chester, OH (US); Siegfried Kurt Hustedt, Kronberg (DE); Scott Andrew Jackson, Cincinnati, OH (US); Jochen Erich Kawerau, Kronberg (DE); Ulrich Pfeifer, Kronberg (DE); Richard Darren Satterfield, West Chester, OH (US); Heidrun Annika Schmelcher, Kronberg (DE); Franziska Schmid, Kronberg (DE); Jens Uwe Stoerkel, Kronberg (DE); Benjamin John Wilson, Kronberg (DE); Tilmann Winkler, Kronberg (DE)

(73) Assignee: THE PROCTER & GAMBLE CO, Cincinnati, OH (US)

( * ) Notice: Subject to any disclaimer, the term of this patent is extended or adjusted under 35 U.S.C. 154(b) by 722 days.

(21) Appl. No.: 13/683,495

(22) Filed: Nov. 21, 2012

(65) Prior Publication Data

US 2014/0137350 A1 May 22, 2014

Related U.S. Application Data

(60) Provisional application No. 61/562,675, filed on Nov. 22, 2011.

(51) Int. Cl.
*A46B 9/04* (2006.01)
*A46B 5/02* (2006.01)

(52) U.S. Cl.
CPC . *A46B 9/04* (2013.01); *A46B 5/02* (2013.01); *A46B 5/023* (2013.01); *A46B 5/025* (2013.01); *A46B 2200/1066* (2013.01)

(58) Field of Classification Search
CPC ..... A46B 9/04; A46B 5/02; A46B 2200/1066; A46B 5/021
USPC ..... 15/167.1, 143.1, 22.1
See application file for complete search history.

(56) References Cited

U.S. PATENT DOCUMENTS

| | | | |
|---|---|---|---|
| 265,181 | A | 9/1882 | Sylvester |
| 3,936,261 | A | 2/1976 | Jones et al. |
| 4,802,255 | A | 2/1989 | Breuer et al. |
| 5,052,071 | A | 10/1991 | Halm |

(Continued)

FOREIGN PATENT DOCUMENTS

| | | |
|---|---|---|
| CN | 2756064 | 2/2006 |
| CN | 102166064 | 8/2011 |

(Continued)

OTHER PUBLICATIONS

International Search Report, mail date Aug. 7, 2013, 15 pages.

(Continued)

*Primary Examiner* — Monica Carter
*Assistant Examiner* — Stephanie Berry
(74) *Attorney, Agent, or Firm* — James E. Oehlenschlager

(57) ABSTRACT

A personal care article, such as a toothbrush having an inner cavity made in one molding process.

10 Claims, 7 Drawing Sheets

(56) References Cited

U.S. PATENT DOCUMENTS

| | | | | |
|---|---|---|---|---|
| 5,268,005 | A | 12/1993 | Suhonen | |
| 5,313,909 | A | 5/1994 | Tseng et al. | |
| 5,564,152 | A | 10/1996 | Jeannet et al. | |
| 5,722,106 | A | 3/1998 | Masterman et al. | |
| 5,804,127 | A | 9/1998 | Takatori et al. | |
| 5,836,769 | A | 11/1998 | Spencer | |
| 5,845,358 | A | 12/1998 | Woloch | |
| 6,018,840 | A | 2/2000 | Guay et al. | |
| 6,058,541 | A | 5/2000 | Masterman et al. | |
| 6,066,282 | A | 5/2000 | Kramer | |
| 6,151,745 | A | 11/2000 | Roberts et al. | |
| 6,475,553 | B2 | 11/2002 | Guay et al. | |
| 6,553,604 | B1 | 4/2003 | Braun et al. | |
| 6,679,696 | B1 | 1/2004 | McConnell et al. | |
| 6,796,785 | B2 | 9/2004 | Kawamoto et al. | |
| 6,818,174 | B2 * | 11/2004 | Morawski | B29C 45/1704 264/572 |
| 7,389,781 | B2 | 6/2008 | Kemp et al. | |
| 8,297,710 | B2 | 10/2012 | Sakurai et al. | |
| 8,382,208 | B2 | 2/2013 | Baertschi | |
| 8,568,634 | B2 | 10/2013 | Porter et al. | |
| 2002/0074698 | A1 | 6/2002 | Morawski | |
| 2003/0183242 | A1 | 10/2003 | Kemp et al. | |
| 2004/0154112 | A1 | 8/2004 | Braun et al. | |
| 2004/0221410 | A1 | 11/2004 | Padula | |
| 2005/0036821 | A1 * | 2/2005 | Pfenniger | A46B 15/0061 401/123 |
| 2005/0170113 | A1 | 8/2005 | Hill | |
| 2005/0170114 | A1 | 8/2005 | Hill | |
| 2005/0188487 | A1 | 9/2005 | Moskovich et al. | |
| 2006/0080794 | A1 | 4/2006 | Punshon | |
| 2006/0151539 | A1 | 7/2006 | Tsubaki et al. | |
| 2006/0272112 | A9 | 12/2006 | Braun et al. | |
| 2007/0163064 | A1 * | 7/2007 | Wong et al. | 15/143.1 |
| 2007/0251040 | A1 | 11/2007 | Braun et al. | |
| 2007/0272652 | A1 | 11/2007 | Beale | |
| 2009/0158540 | A1 * | 6/2009 | Baertschi | A46B 5/0025 15/143.1 |
| 2011/0041272 | A1 | 2/2011 | Prencipe et al. | |
| 2014/0047656 | A1 | 2/2014 | Newman et al. | |
| 2014/0137349 | A1 * | 5/2014 | Newman et al. | 15/143.1 |
| 2014/0137353 | A1 | 5/2014 | Wen et al. | |
| 2014/0137354 | A1 | 5/2014 | Newman et al. | |
| 2014/0138880 | A1 | 5/2014 | Pfeifer et al. | |

FOREIGN PATENT DOCUMENTS

| | | |
|---|---|---|
| CN | 2160251 | 10/2015 |
| DE | 4136537 | 1/1993 |
| DE | 19531368 | 2/1997 |
| DE | 10023725 | 11/2001 |
| DE | 102005036301 | 2/2007 |
| EP | 0668140 | 8/1995 |
| EP | 0721832 | 4/1999 |
| EP | 1639913 | 3/2006 |
| JP | H1016037 | 1/1998 |
| WO | WO2004077996 | 9/2004 |

OTHER PUBLICATIONS

U.S. Appl. No. 13/683,655, filed Nov. 21, 2012, Matthew Lloyd Newman et al.
U.S. Appl. No. 13/683,716, filed Nov. 21, 2012, Cathy Wen et al.
U.S. Appl. No. 13/683,744, filed Nov. 21, 2012, Matthew Lloyd Newman et al.
U.S. Appl. No. 13/683,801, filed Nov. 21, 2012, Ulrich Pfeifer et al.
U.S. Appl. No. 13/683,445, filed Nov. 21, 2012, Matthew Lloyd Newman et al.

* cited by examiner

TOOTHBRUSH HAVING AN INNER CAVITY

FIELD OF THE INVENTION

The present invention relates to toothbrushes having an inner cavity.

BACKGROUND OF THE INVENTION

Toothbrushes are typically manufactured using an injection molding process. Such an injection molding process is characterized by providing a mold in the shape of the toothbrush and injecting molten plastic through a hot channel nozzle into the mold. The toothbrush is then cooled and ejected from the mold. For example, U.S. Pat. No. 5,845,358 shows such a toothbrush made by injection molding. One of the limitations of the conventional injection molding processes is that large diameter handles, and especially large handles with a substantial variation in cross sectional area where cross sectional area both increases and decreases along the length or major axis of the brush, cannot be produced in an efficient manner, due to the cost of increased material and lengthened cooling times, resulting from the increased mass of material used.

Toothbrushes with increased handle diameters provide substantial advantages, for instance they can provide increased gripping area for children increasing the ability of children to handle and use toothbrushes; also people with disabilities such as arthritis sometimes have difficulty in handling toothbrushes due to difficulty in flexing the joints in their hands. Such difficulties are considerably relieved by means of toothbrushes having increased handle diameters. Additionally, the larger cross section handles on the toothbrushes are better for the user from an ergonomic point of view. Variations in cross sectional area, including both larger and smaller cross sectional areas, along the length or major axis of the brush assists the user in the grip and handling of the brush during use, when it must be rapidly moved while it may also be wet or slippery.

In an attempt to overcome the difficulties associated with the use of injection molding to produce toothbrush handles having increased diameters, it has been suggested to produce toothbrush handles having a hollow body. For example, EP 0 668 140 or EP 0 721 832 disclose the use of air assist or gas assist technology to make toothbrushes having hollow, large cross-sectional handles. In the disclosed process, molten plastic is injected near the base of the toothbrush handle, wherein subsequently a hot needle is inserted into the molten plastic to blow gas into the molten plastic which is then expanded towards the walls of the injection mold. In a similar manner, U.S. Pat. No. 6,818,174 B2 suggests injecting a predetermined amount of molten plastic into the cavity to only partially fill the mold cavity and subsequently inject a gas through a gas injection port formed in the injection mold to force the molten plastic into contact with the walls of the mold cavity. CN102166064 discloses a toothbrush having a hollow handle and a method for producing such a toothbrush. When the molten plastic material is injected into the toothbrush handle die cavity of the brush handle, a blow hole is formed in the toothbrush handle, gas is blown into the center of the toothbrush handle through the blow hole, and the blow hole is sealed after the toothbrush handle is shaped. The toothbrush described here has a hollow handle and a solid head made through a gas-assisted injection molding process. The hollow handle made in this method reduces the amount of material used by 10~50% as compared to a solid toothbrush handle. Such injection molding processes using additional air injection have substantial difficulty forming hollow handle bodies with substantially uniform wall thickness, and as such, the potential for optimization of a handle for maximum ergonomic function in minimum material weight and manufacturing efficiency is limited. A further drawback to such injection molding processes is the creation of a vent hole for the gas. The vent hole is formed at the interface of molten plastic and high-pressure gas (and not by mold steel) and thus cannot be made predictably or with high precision. A still further drawback of hollow-handled toothbrushes made using gas-assist injection molding relates to the application or installation of a second, third or subsequent material to the toothbrush by injection molding, or overmolding, where the over-molded material may, in the process of sealing the necessary gas vent, intrude substantially into the hollow void created in the first gas injection step, as there is nothing to stop it besides friction and the near-atmospheric pressure inside the void. Finally, gas-assist injection molding does not substantially reduce injection pressure or melt energy required to form a plastic article.

A conventional method to create toothbrush handles having increased cross sections, such as electromechanical toothbrush handles, is to manufacture discrete parts of the handle separately using injection molding, then to assemble these parts in either a separate non-injection molding step, or in a subsequent injection molding step whereby the discrete parts from the first step or steps are inserted into an injection mold first and one or more additional materials are injected around them, creating a hollow body from multiple parts. This manufacturing method still has the drawbacks of: requiring the complete melting of plastic, high pressures and associated equipment involved with injection molding, and in addition may have added labor expense associated with both in-mold and out-of-mold assembly of discretely-molded parts. The use of injection molding to create multiple discrete parts also has the disadvantage that each part must not contain any substantial undercut from which the mold core forming a concave surface of the injection-molded part could not be extracted from the part after molding. Further, mold cores must typically contain some mechanism to cool or remove heat, typically embodied as internal channel through which chilled water is forced, and would thus be difficult or impossible to make internal geometry for most manual toothbrushes which may have diameters of 10 mm and lengths beyond 100 mm. The lack of undercuts in discrete parts combined with the length and diameter of cores required to make non-undercut handle parts combined with the desire for multiple areas of variation in cross sectional area on a toothbrush handle would thus require any discretely-assembled handles to have multiple mating surfaces, which would preferably require seals to maintain barriers to moisture and debris under extensive and repeated use.

Electromechanical toothbrushes in particular are susceptible to problems of assembly, as they are necessarily hollow in order to include batteries, motors and associated electrical linkages and drive components which must be all placed inside with some degree of precision. To avoid the problems and expense of welding plastic parts together and multiple assembly steps of a sealed outer shell, it has been proposed to blow mold the handle for electromechanical toothbrushes. In the assembly of a blow molded electromechanical toothbrush it is necessary to leave the blow molded portion of the handle open in at least one end to accommodate the motor, batteries, and drive system components. In this process, the minimum diameter of at least one opening to the blow molded handle must exceed the smallest linear dimension of every component that will be inserted. Such a large opening would be a drawback in a non-electromechanical handle, which has no need to accommodate internal component entry, and would necessitate an overly-large second part or cap to prevent intrusion and collection of water, paste, saliva and other detritus of conventional use. Such an overly-large opening, if positioned near the head, would interfere substantially with ergonomic use of the brush. Additional constraints to the geometry on the inside surface of the cavity, for example to locate motors, housings, batteries, etc. which must be positioned inside accurately as to be rigidly fixed will also be detrimental to the overall blow molding process, as the majority of the inner cavity surface of a blow molded part cannot be defined directly by steel in the mold surfaces, and is instead defined indirectly by steel on the outer surface of the handle combined with the wall thickness of the parison, blowing pressure and stretch ratio of the final part to the original parison or preform thickness. Such constraints of these process variables will necessarily limit manufacturing efficiencies.

To accommodate activation of electrical components via a standard button or mechanical switch, at least some portion of a blow molded electromechanical toothbrush handle should be made thin enough to flex substantially under pressure of a finger or hand squeeze. Such a thin-walled structure or film-walled structure necessarily requires some strengthening mechanism to ensure durability and rigidity under use. An internal frame or cap, as described in WO 2004/077996 can be used to provide this necessary strengthening mechanism in an electromechanical toothbrush, but would be a drawback to a manual brush, which does not require additional components to function adequately, in extra expense, complexity and additional load-bearing parts. Further, due to the linear nature of the motor, power source, and drive shaft of electromechanical toothbrushes there are no or minimal variations to the cross-sectional area of the inner cavity; such that the inner cavity walls provide mechanical support to the internal components to reduce or eliminate unwanted movement or shifting.

An electromechanical toothbrush handle, made by blow molding or injection molding, is typically manufactured with an opening at either end: At a distal end there is typically an opening to accommodate the mechanical translation of power through a drive mechanism to the toothbrush head, and at a proximal end there is typically an opening to accommodate insertion of components during manufacturing and possibly also insertion or removal of the battery by the user. Such a second opening would be unnecessary for a manual toothbrush and would create drawbacks in the need for additional seals and mechanical fasteners. In some blow molding processes, the formation of openings at the distal and proximal ends of the molded part are intrinsic to the process and would benefit the formation of a double-open-end handle, but would not be necessary for a manual toothbrush handle.

There are several advantages to making toothbrush handles lighter in weight overall, regardless of cross section or changes to the size. Lighter handles could provide a more tactile feedback of forces transmitted from the teeth through the bristles to the head to the handle to the hand during brushing. Lighter toothbrush handles would also ship in bulk with greater efficiency from manufacturing centers to retail centers where they are purchased by users. To reduce weight while maintaining stiffness, some toothbrush handles are made from bamboo or balsa wood, however these materials have disadvantages in that they are not easily formable into complex three-dimensional shapes which can be comfortably gripped. Further, these materials are anisotropic, meaning they have an elastic modulus and yield strength or ultimate strength which varies with the direction which load is applied. Carbon-fiber composites and glass-filled injection-molded plastics are other common examples of anisotropic materials which could be used to make lighter and stronger toothbrushes. Articles made from these materials must therefore be formed with their strongest axis or 'grain' aligned substantially with the major axis of the article in order to resist fracture during the bending forces common to use. This creates an extra necessary step in the preparation of the material prior to forming or machining. This alignment of the grain also can present a specific disadvantage to woods in general in that the presentation of splinters of material is most likely to occur in the direction aligned to typical forces applied by the hand during brushing.

To make toothbrush and personal care articles lighter without relying on anisotropic materials such as woods, the articles could be made lighter through the use of non-homogeneous but isotropic materials, such as foamed plastics. Foamed plastics present an advantage in that they can offer a higher strength-to-weight ratio than solid plastics without regard to material orientation. The overall weight savings possible with foamed plastics may be limited however, as the bubbles inside the plastic which create the weight savings also create stress concentrations which will severely reduce strength in tension. While foamed plastics can provide substantial strength in compression (and are used for exactly this purpose in applications such as packing materials where weight is a critical issue) the weakness in tension severely affects bending strength and prevents uniformly-foamed plastics from serving as load-bearing elements in articles which must maintain strength and stiffness in bending during normal use.

It is familiar to those in the art to use extrusion blow molding to create lightweight hand-held articles, such as children's toys, such as hollow, plastic bats, golf clubs or any large, plastic article which benefits from being lighter in weight. While these articles can be both stiff and strong in bending, they also generally contain drawbacks which would limit their general use in semi-durable, Class-I medical devices, such as toothbrushes. First, such articles typically contain significant flash along parting lines, or in any locations where the parison is larger in cross sectional area than is the cavity to which it is blown. In these locations the parison folds within the cavity and substantial flash is created, even in the absence of cavity parting line. Second, most articles contain some significant vestige of blowing in the form of a hole, which may be accurately or inaccurately formed. Such a vestige would be regarded as a significant defect in a Class-I medical device which must prohibit breach or entry of contaminants to a hollow interior which may not drain effectively. Third, the relative size of these articles is large in comparison to the size of these defects, and the overall function of the articles is not severely affected by these defects. In many cases, the size of the article itself renders the manufacturing process easier, with respect to the minimization of defects. It is not challenging to extrusion blow mold articles, packages or bottles in the size range common to manual toothbrush handles—if the plastic wall thickness can be minimized in proportion to the overall cross section. Such articles exist in the form of small, typically squeezable, tubes or bottles which in fact benefit from having a very thin, deformable wall which enables dispensing of internal contents, making them unusable as toothbrushes.

Extrusion- and injection-blow-molded handles for semi-durable consumer goods such as feather dusters and tape dispensers are also known but again these articles would not meet criteria for semi-durable Class I medical devices, specifically with regard to the sealing of the necessary blowing orifice against intrusion of water or other contamination, and in the case of extrusion blow molding, in the appearance of flash on the articles in areas that would directly contact or go into the mouth. These articles are also generally very brittle and when too much force is applied often break or snap, producing sharp edges, making them unusable for use in the oral cavity.

It has also been proposed to manufacture manual toothbrushes by blow molding, and in fact it should not prove challenging to extrusion blow mold, injection blow mold, or even injection-stretch blow mold such an article in the general shape and size of a toothbrush or toothbrush handle, however no existing disclosure in the prior art addresses the issues of: Strength in bending, stiffness in bending, overall rigidity, mitigation of flash or other sharp defects, variations in cross-sectional area, and obstruction or sealing of the blow hole vestige. Any one of these defects in a blow molded toothbrush or toothbrush handle would severely affect the utility of the article, and as such, improvements are needed to enable a hollow article with material savings maximized by uniform wall thickness which is suitably strong and stiff in bending without breaking in use and does not leak or present uncomfortable defects to the user.

In view of these drawbacks of the prior art, it is an objective of the present invention to provide an improved toothbrush having an inner cavity, which avoids the drawbacks of the prior art.

SUMMARY OF THE INVENTION

A toothbrush is provided that comprises a head, neck, handle, handle end, head end, outer surface, inner cavity, and longitudinal axis; the inner cavity having a surface defining a cross-sectional area; wherein the inner cavity has at least one of a greater cross-sectional area, bordered by two lesser cross-sectional areas along the longitudinal axis of the toothbrush or a lesser cross sectional area bordered by two greater cross-sectional areas along the longitudinal axis of the toothbrush; the outer surface defining an outer surface cross-sectional area; a wall formed from the outer cavity surface and inner cavity surface; wherein the toothbrush comprising a single unitary component along the entire length.

A toothbrush is provided that comprises head, neck, handle, handle end, head end, outer surface, inner cavity, and longitudinal axis; the inner cavity having a surface defining a cross-sectional area; wherein the inner cavity has at least one of a greater cross-sectional area, bordered by two lesser cross-sectional areas along the longitudinal axis of the toothbrush or a lesser cross sectional area bordered by two greater cross-sectional areas along the longitudinal axis of the toothbrush; the outer surface defining an outer surface cross-sectional area; a wall formed from the outer cavity surface and inner cavity surface; the toothbrush comprising a single unitary component; wherein the toothbrush comprises two or more material layers.

DETAILED DESCRIPTION OF THE INVENTION

The present invention relates to personal care articles having an inner cavity, such as a hollow toothbrush that may have different colors, materials, and surface decorations on either or both of the inner cavity or outer surface. The inner cavity varies in cross-sectional area along the length or the longitudinal axis of the toothbrush, wherein the inner cavity is essentially open as compared to an open or closed cell foam material. The unitary toothbrush is made of at least one continuous material extending along the entire longitudinal axis of the toothbrush such that the head, neck and handle of the unitary toothbrush is essentially one part. This one or more continuous material provides the structural strength of the toothbrush. The unitary toothbrush may include separate non-structural elements, such as labels, grip structures, bristles, etc. In certain embodiments the inner cavity is closed with no opening to the outer surface of the toothbrush.

Personal care articles are items used to store, dispense, apply or deliver benefits to a consumer's personal health, beauty, grooming, or other body or human biological system care, maintenance, enhancement or improvement. Examples of personal care articles include, but are not limited to toothbrushes, toothbrush handles, razors, razor handles, mop handles, vacuum handles, makeup or beauty care applicators, skin care applicators, feminine hygiene applicators, hair care applicators, hair colorant applicators, or hair care articles.

Figure 1:
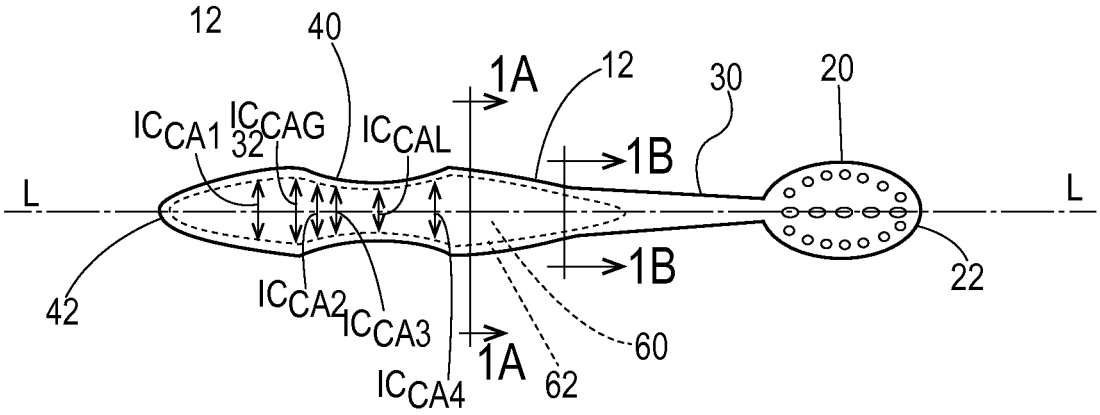
FIG. 1 is a perspective view of a toothbrush according to an embodiment of the present invention.
Figure 1A:
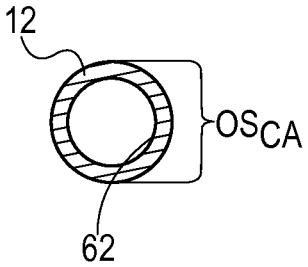
FIG. 1A is a cross-sectional view of FIG. 1 along section line 1A according to an embodiment of the present invention.
Figure 1B:
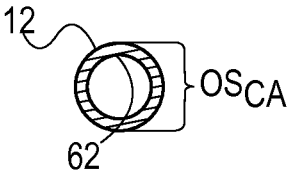
FIG. 1B is a cross-sectional view of FIG. 1 along section line 1B according to an embodiment of the present invention.
Figure 2:
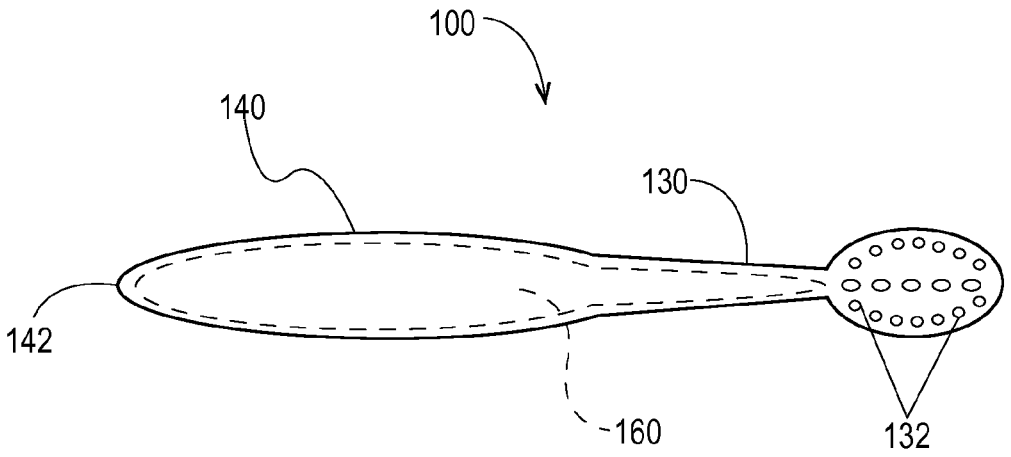
FIG. 2 is a perspective view of a toothbrush according to an embodiment of the present invention.

FIG. 1 shows an embodiment of a personal care article, a toothbrush 10 having a head 20, neck 30, handle 40, a handle end 42 and a head end 22. The toothbrush 10 may be unitarily formed as a single piece and comprise an inner cavity 60 and an outer surface 12, wherein the outer surface 12 varies in cross-sectional area ($OS_{CA}$), which is the total area of the cross-section as defined by the outer surface 12, along the toothbrush 10 longitudinal axis L—as shown in FIG. 1A; in this embodiment the handle 40 has a substantially hourglass shape. The inner cavity 60 has an inner cavity surface 62, wherein the inner cavity surface 62 varies in cross-sectional area ($IC_{CA}$) along the toothbrush longitudinal axis L. As FIG. 1 shows, in certain embodiments the inner cavity 60 of the toothbrush 10 has a greater cross-sectional area $IC_{CAG}$ bordered along the longitudinal axis L of the toothbrush 10 by cross-sectional areas $IC_{CA1}$, $IC_{CA2}$ having a smaller area than the greater cross-sectional area $IC_{CAG}$ to form a contour. A toothbrush 10 inner cavity 60 may also have a lesser cross-sectional area $IC_{CAL}$ bordered along the longitudinal axis L of the toothbrush 10 by cross-sectional areas $IC_{CA3}$, $IC_{CA4}$ having a greater area than the lesser cross-sectional area $IC_{CAL}$, to form a contour. In another embodiment, the cross-sectional area at the handle end of the brush is smaller than at least one or more other cross-sectional area along the longitudinal axis L of the toothbrush 10. Further, as shown in FIGS. 1, 1A and 1B, in certain embodiments the inner cavity surface 62 varies in the square root of the cross-sectional area ($IC_{CA}$) proportionally to the variations of the square root of cross-sectional area ($OS_{CA}$) of the outer surface 12 along the longitudinal axis L of the toothbrush 10. In another embodiment, the cross-sectional area of the toothbrush wall (thermoplastic material forming the toothbrush that is positioned between the inner cavity surface and the toothbrush outer surface), which is the difference between the outer surface cross-sectional area ($OS_{CA}$) and the inner cavity surface cross-sectional area ($IC_{CA}$) varies less than about 25%, 20%, 15%, 10%, 5% over at least 50%, 70%, 80%, 90% of the inner cavity length along the longitudinal axis of the toothbrush. This is the case when the thickness of the toothbrush wall at the inner cavity portion varies in inverse proportion to the average perimeter of the outer surface and inner cavity along the longitudinal axis L of the toothbrush. In another embodiment, the thickness of the toothbrush wall at the inner cavity portion remains substantially constant along the longitudinal axis of the toothbrush. As shown in FIG. 1 the head 20 and at least a portion of neck 30 along the longitudinal axis L of the toothbrush 10 may be substantially solid or as shown in FIG. 2 in a toothbrush 100 the inner cavity 160 may extend from the handle 140 into the neck 130 but not passing the first tuft hole 132 closest to the handle end 142 of the toothbrush 100. In certain embodiments, the percentage of air void volume to the volume of the brush handle and neck ranges from about 50% to about 70%; or from about 55% to about 70%; this means the same percentage of material is saved compared to a solid toothbrush with the same shape and size. In these embodiments, the amount of thermoplastic material can be reduced by 50% to 70% compared to that used in solid toothbrushes having the same shape and size. It is documented that a gas-assisted injection-molded hollow freezer door handle save a maximum of 27% of material compared to a solid freezer door handle of the same shape and size. Practically, any hollow gas-assisted injection-molded toothbrushes can save a maximum 30% of material compared to a solid toothbrush of the same shape and size.

Figure 3:
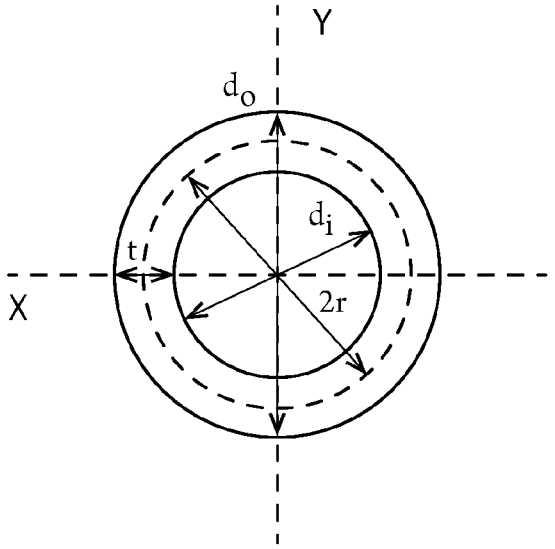
FIG. 3 is a representation of a cross-sectional view of a unitary toothbrush with an inner cavity.

A hollow toothbrush with a wide handle and inner cavity actually has very high bending strength to volume ratio. The thinner the wall thickness is compared to the mean radius r at any cross-section, the bigger the structural strength to volume ratio. Wherein the mean radius is defined as the mean perimeter of the hollow cross-section divided by $2\pi$. The mean perimeter of the hollow cross-section is defined as the average of the perimeter of the outer surface and inner cavity at that cross-section. Let's simplify a toothbrush with inner cavity as a hollow cylindrical beam under bending condition as illustrated in FIG. 3. It can be shown, the bending strength $K_B$ to volume V ratio of a toothbrush with inner cavity varies positively to the ratio of mean radius r to thickness t. The bigger the ratio of $$\frac{r}{t},$$

the bigger the ratio of $$\frac{K_B}{V}.$$

Similar relation will follow for a non-cylindrical toothbrush with contour and inner cavity. Hence, the unitary toothbrush with inner cavity of present invention has ratio of mean radius to thickness $$\frac{r}{t}$$

in the range of 3 to 10 in at least about 80% of the hollow portion along the longitudinal axis. At the transition from the hollow portion of the toothbrush to its solid portion, the wall thickness tends to increase and is excluded from the wall thickness measurement. On the other hand, the ratio of mean radius to thickness $$\frac{r}{t}$$

of a solid cylindrical beam have is ½. Whereas, the ratio $$\frac{r}{t}$$

of some other hollow handles of a toothbrush existing in prior art such as the gas-assisted injection molding toothbrushes can be from 0.7 to 2.

The toothbrush should also be rigid enough to withstand a squeezing force by consumers. The radial strain of a hollow toothbrush under squeezing force or squeezing pressure is also directly proportional to $$\frac{r}{t}.$$

It is found from testing physical hollow toothbrush samples with inner cavity, that as long as the toothbrush is thick enough and $$\frac{r}{t}$$

is less than 8 or even less than 10, the radial deformation under normal squeeze force will not be noticeable by consumers.

Whereas, the thickness variation of other hollow handles of a personal care article, such as a toothbrush of prior art, such as gas-assisted injection molded toothbrushes will have significantly wall thickness variation along the circumferential direction of a cross-section, particularly at any sharp corner of the cross-section. For example, in one gas-assisted injection molded handle, the thickness vary from 1.9 mm to 4.3 mm at one cross-section. The cross-section of the outer surface of the handle has an irregular shape with sharp corners. The inner cavity of the handle is unable to follow the shape of the outer surface. At the sharp corner, the thickness changes abruptly from 1.9 mm to 4.3 mm, which is a 2.4 mm abrupt change. This abrupt thickness change would not happen in the toothbrush with inner cavity of present invention. The mean thickness is about 3.1 mm of the cross-section. The mean radius of the hollow cross-section is 2.35 mm. The ratio of mean radius to thickness $$\frac{r}{t}$$

is 0.76, which is far smaller than 3.

Now, let's look at the mean wall thickness distribution of any cross-section in the hollow portion along the longitudinal axis of the toothbrush.

Figure 4:
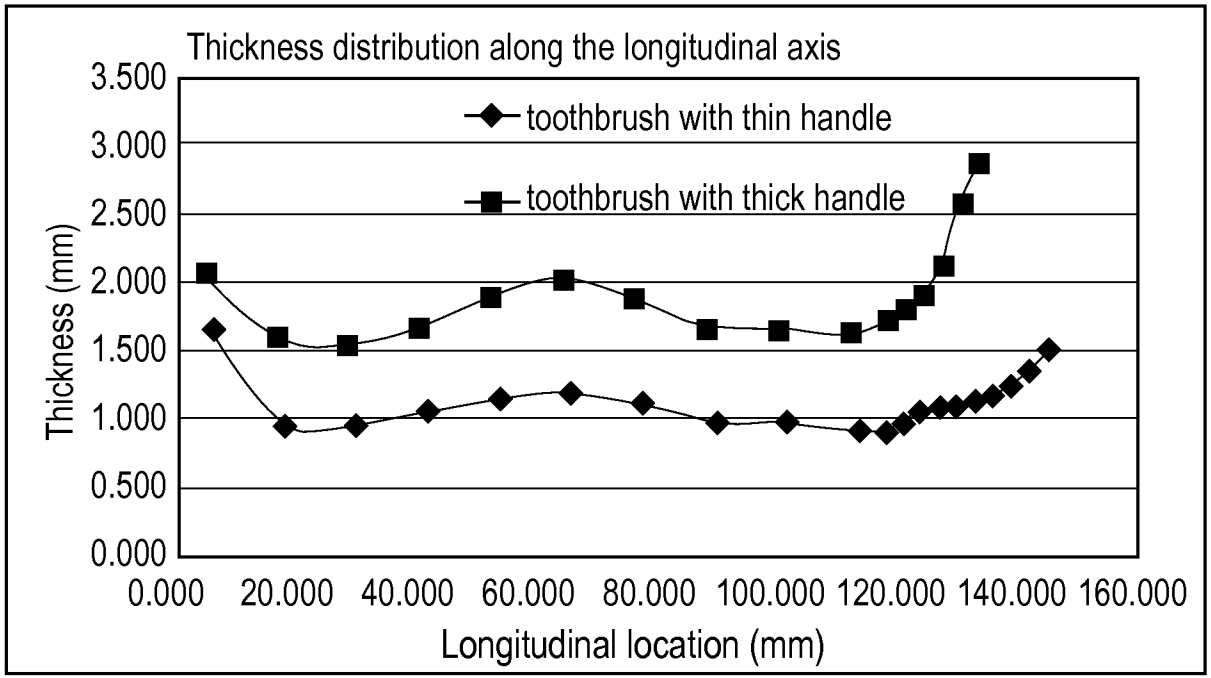
FIG. 4 is a chart showing the variation in wall thickness of two unitary toothbrushes having an inner cavity along the longitudinal axis.

In previous embodiment of the hollow toothbrush with thin handle, the mean wall thickness at any cross-section of a unitary toothbrush in 80% of the hollow portion along the longitudinal axis have a range of 0.9 to 1.2 mm, with a mean thickness of 1.07 mm. The wall thickness varies less than 15% from its mean wall thickness in 80% of the hollow portion along the longitudinal axis. The ratio of the mean radius to thickness $$\frac{r}{t}$$

has a range of 3.9 to 8.4 in 80% of the hollow portion along the longitudinal axis. This is a unitary toothbrush with a thin handle. The mean wall thickness of any cross-section of the unitary toothbrush with inner cavity and thin handle is also a continuous function along the longitudinal axis of the toothbrush. This means, the change in the mean wall thickness of any cross-section from one cross-section to the next one is less than 0.5 mm, as shown in FIG. 4.

In another embodiment, the wall thickness of a unitary toothbrush in 80% of the hollow portion along the longitudinal axis has a range of 1.55 to 2.07 mm, with a mean thickness of 1.76 mm. The wall thickness varies less than 17% from its mean wall thickness in 83% of the hollow portion along the longitudinal axis. The ratio of mean radius to thickness $$\frac{r}{t}$$

has a range of 3 to 4.7 in 80% of the hollow portion along the longitudinal axis. This is a unitary toothbrush with a thick handle. The change in the mean wall thickness of any cross-section from one cross-section to the next one is less than 0.5 mm, as shown in FIG. 4.

In both the above two embodiments of the unitary toothbrushes with inner cavity, the toothbrushes have the required structural and bending strength for consumers to brush their teeth effectively.

The wall thickness may vary along the longitudinal axis of the toothbrush by controlling the parison thickness profile in an extrusion blow molding process. We would like to call out three embodiments that could be desirable.

In one embodiment, the cross-sectional area remains constant in 80% of the hollow portion along the longitudinal axis of the toothbrush. In this embodiment, the wall thickness varies in inverse proportional to the mean radius of the toothbrush along the longitudinal axis.

In one embodiment, it is desirable that the mean thickness of the toothbrush remains constant in 80% of the hollow portion along the longitudinal axis of the toothbrush. In this embodiment, the cross-sectional area of the toothbrush will vary in proportional to the mean radius of the toothbrush along the longitudinal axis.

Yet in another embodiment, it is desirable that the mean thickness vary in proportion to the mean radius of the toothbrush along the longitudinal axis, i.e.

$$\frac{r}{t}$$

remains constant and can be any well from 3 to 10. In this embodiment, the cross-sectional area of the toothbrush will vary in proportional to the square of mean radius of the toothbrush along the longitudinal axis. The benefit of this embodiment is that the toothbrush remains constant bending strength and rigidity along the longitudinal axis.

With reference back to FIG. 1 the handle 40 is connected to a head 20 through a neck 30 which, in comparison to the handle 40, or the head 20 has a smaller cross-sectional area. As illustrated in FIG. 1 the head 20 of the toothbrush 10 supports a plurality of cleaning elements, such as bristles or tufts of bristles. The bristles or tufts of bristles may comprise nylon, PBT, and TPE.

In addition to bristles or tufts of bristles, the toothbrushes of the present invention may include any suitable cleaning element which can be inserted into the oral cavity. Some suitable cleaning elements include elastomeric massage elements, elastomeric cleaning elements, massage elements, tongue cleaners, soft tissue cleaners, hard surface cleaners, combinations thereof, and the like. The head may comprise a variety of cleaning elements. For example, the head may comprise bristles, abrasive elastomeric elements, elastomeric elements in a particular orientation or arrangement, for example pivoting fins, prophy cups, or the like. Some suitable examples of elastomeric cleaning elements and/or massaging elements are described in U.S. Patent Application Publication Nos. 2007/0251040; 2004/0154112; 2006/0272112; and in U.S. Pat. Nos. 6,553,604; 6,151,745. The cleaning elements may be tapered, notched, crimped, dimpled, or the like. Some suitable examples of these cleaning elements and/or massaging elements are described in U.S. Pat. Nos. 6,151,745; 6,058,541; 5,268,005; 5,313,909; 4,802,255; 6,018,840; 5,836,769; 5,722,106; 6,475,553; and U.S. Patent Application Publication No. 2006/

0080794. Further the cleaning elements can be arranged in any suitable manner or pattern on the toothbrush head.

In certain embodiments of the present invention, a personal care article, such as a toothbrush, may be made of more than one material or layer. In certain embodiments, a toothbrush may comprise a primary component or layer forming the majority of the toothbrush and a secondary layer forming a minority of the toothbrush, wherein the second layer, in certain embodiments, may be less than about 0.4 mm thick and greater than about 1 $cm^2$ in area. In particular, a multiple-component extrusion process may be used, wherein different portions of the personal care article are formed by different materials. For example, in a toothbrush, the contact surface portions which are contacted by the thumb or the finger tips can be made of soft plastic so that it feel soft or easy of grip, whereas the remaining portions of the toothbrush can be made of hard plastic to give the toothbrush sufficient rigidity. In one embodiment, the soft plastic should not be slippery or have high coefficient of friction when it is wet, so that when brushing the teeth and the handle gets wet, the user can grip it easily without losing control of the brush handle. Thermoplastic elastomer (TPE) can be used for soft plastic. In another embodiment, the head and neck part of a toothbrush can have two layers with the outer layer being a soft plastic for softness and inner layer being a hard plastic for rigidity and tufting support. Yet in another embodiment, part or a strip of the toothbrush parallel to the longitudinal axis of the toothbrush may have two layers of material with the external layer having a different material or a different color from the rest of the toothbrush. In still another embodiment of the toothbrush, one part of the toothbrush, for example the neck, can have two layers of different materials, while the other parts of the toothbrush, such as the handle, have only one layer of the material; creating a different grip, feel, color decoration on different parts of the toothbrushes. The two layers can be made by feeding a multi-layer parison into the mold. By controlling the presence of a second layer parison both in the longitudinal direction and in the circumferential direction, the presence of the second layer on the toothbrush can be controlled both in the longitudinal direction and in the circumferential direction. In certain embodiments a separate part can be inserted into one position of the mold and can be held in position on one side of the mold cavity wall either by vacuum suction or by the natural dimensional curvature of the mold. One or more separate part can be also inserted into the mold and attached to the mold cavity wall in the same manner. These in-mold attached parts can be a thin layer of a different material with different colors or surface texture or 3D texture. In certain embodiments, such a part can be a thin TPE film label of different color or thickness that provides color differentiation as well as soft and wet grip. In certain embodiments, it can be a small electronics part that has a timer and display to indicate a predetermined brushing time. In certain embodiments, it can be a small electronics part that plays sound or music for two minutes. In still more embodiments, it can be made of color change material that changes with pressure, temperature, moisture or timing. Yet in another embodiment, it can be textile with 3D texture or open weave made of TPE or Ethylene vinyl acetate (EVA) that provide additional decoration to the toothbrush.

In certain embodiments a toothbrush having an inner cavity may have a center of gravity closer to the head than to the geometric center of the outer surface of the toothbrush than is normally possible with a solid brush of conventional shape, which may provide for improved dexterity or ergonomics during brushing, or the center of gravity may be placed further from the head than is possible with a solid, homogeneous brush, for example by placement of permanently-mounted weights inside the hollow portion of the handle, which may provide for example improved tactile response of the forces transmitted from the teeth to the head to the handle. Such manipulation of center of gravity may provide for additional benefits in handling during brushing or storage with no compromise to design elements such as shape, material, or color that appear on the outside of the handle. In addition, a toothbrush having an inner cavity may have an equivalent density in certain embodiments below 0.60 $g/cm^3$, or below 0.20 $g/cm^3$ in plastic or 0.10 $g/cm^3$ in metal while maintaining a modulus or strength sufficient to resist bending during even heavy brushing without concern of alignment or particular arrangement of any raw material or load-bearing element (in contrast to materials having a grain, such as wood or carbon fibers), which is difficult to achieve in a toothbrush whose handle is substantially solid and made from common isotropic, homogeneous materials such as plastic or metal. An equivalent density is defined as the ratio of the overall mass to the overall volume defined by the outer surface of the toothbrush. In certain embodiments, the equivalent density of the toothbrush with inner cavity is from about 0.2 g/cc to about 0.5 g/cc. In certain embodiments the handle of both toothbrushes does not deform when squeezed by fingers.

The material of the toothbrush can be any thermoplastic resin having one or more properties suitable for a hollow toothbrush, such as melt flow properties allowing for blow molding, chemical resistance, and sufficient impact strength. Examples of typical materials include but not limited to an impact modified polypropylene or high density polyethylene (HDPE). Examples of materials used for soft external layers can be a TPE material with different hardness. The toothbrush can also have a secondary decorative material such as a thin TPE layer on a small part of the toothbrush such as the thumb rest or thumb grip area. In certain embodiments when a toothbrush is formed using extrusion blow molding, because of the large strain of the half-molten parison in the compression mold at the brush head portion to from the large number of small closely packed deep tuft hole, the primary base thermoplastic resin that is fed into the blow molding machine in a pellet form may have a melt flow index (MFI) in a range of about 1 g/10 min to about 4 g/10 min at 230° C. and 2.16 kg force measured at standard ASTM D1238 test method. The MFI should not be too small, for example <1 g/10 min, because a resin with <1 g/10 min MFI forms a parison that is too viscous to flow freely to fill the narrow deep gap between the tuft holes with large strain. The temperature of the parison can be increased to reduce the viscosity to some extent. The normal temperature range of an extrusion blow molding process is 176~232° C. Setting temperature too high can result in burning the resin and inconsistency in the property of the melted resin. For example, for a polypropylene (PP) resin with a MFI of 0.37 and 0.47 flow the temperature has to be set above 246° C. to form a toothbrush with tuft holes, but part quality is bad and very inconsistent. However when the MFI is too high, for example when the MFI of the resin exceeds 3 g/10 min, the Parison becomes too runny and cannot support itself and may collapse before it is clamped in the mold. Reducing the temperature of the parison may reduce the viscosity of the parison to support itself, but reducing the temperature can make parison performance very inconsistent from one shot to the next. To form a parison that can be used to form a unitary toothbrush, in certain embodiments the temperature is from about 199° C. to about 221° C. and the MFI is from about 1.5 to about 2.5 MFI. The MFI of colorant is also important. Although the Let Down Ratio (percentage of the colorant in weight that is mixed into the base thermoplastic resin) of colorant is usually around 2 to 5%, but at 30 MFI vs 15 MFI, the viscosity of the parison of the two colored resin can perform significantly differently.

Figure 7:
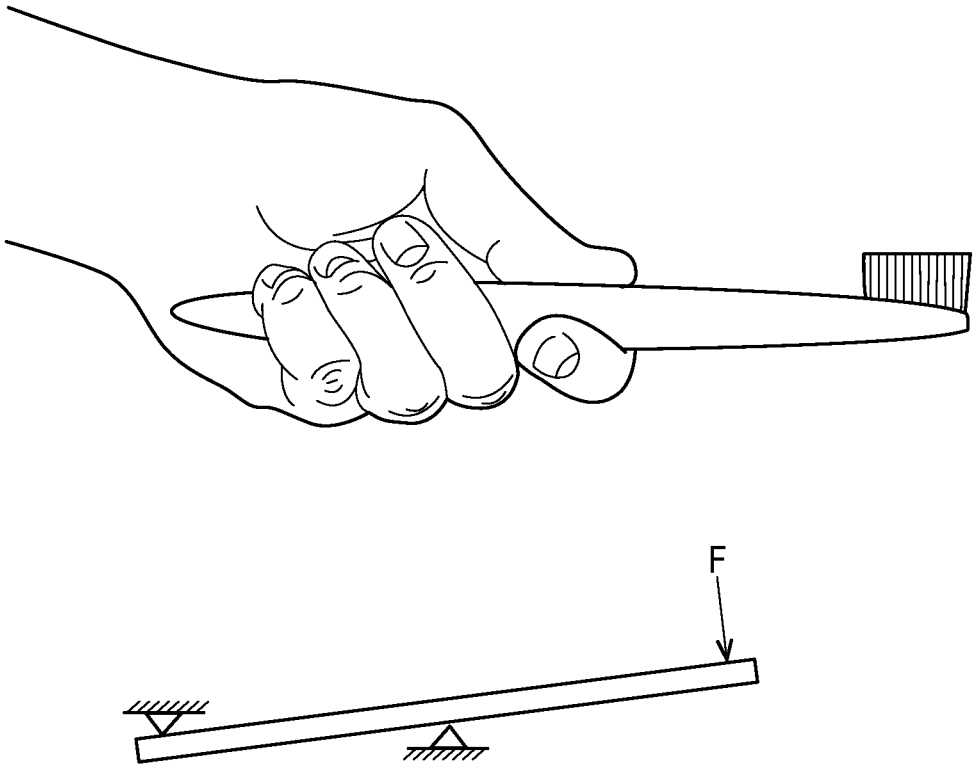
FIG. 7 is diagrammatical representation of a method of analysis.
Figure 8:
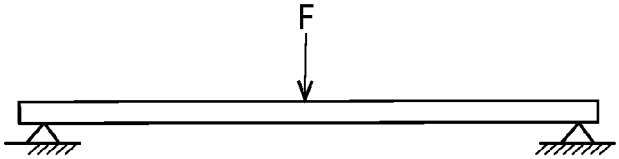
FIG. 8 is diagrammatical representation of a method of analysis.

The unitary toothbrushes of the present invention having an inner cavity can help reduce the amount of excessive force being applied to the toothbrush during brushing, such as when using a typical solid manual toothbrush or electromechanical toothbrush. It is known to those familiar in the art that sustained, repeated brushing with a standard tufted, manual toothbrush with a force of greater than approximately 5.0 N can lead to a loss of gum tissue over time. For instance there exist electromechanical toothbrushes with integrated feedback systems to warn users when this force is exceeded during use. This suggests that a significant fraction of toothbrush users apply forces up to 5.0N through the toothbrush head. An example toothbrush of uniform, rectangular cross section made from a solid, homogeneous, isotropic material could be modeled in grip as shown in FIG. 7. The deflection of the head of the toothbrush in this grip during bending in use can be inferred analytically from the equation used to calculate the flexural modulus of a flat bar of material in three point bending as shown in FIG. 8, and as disclosed in ASTM D 790.

Figure 9:
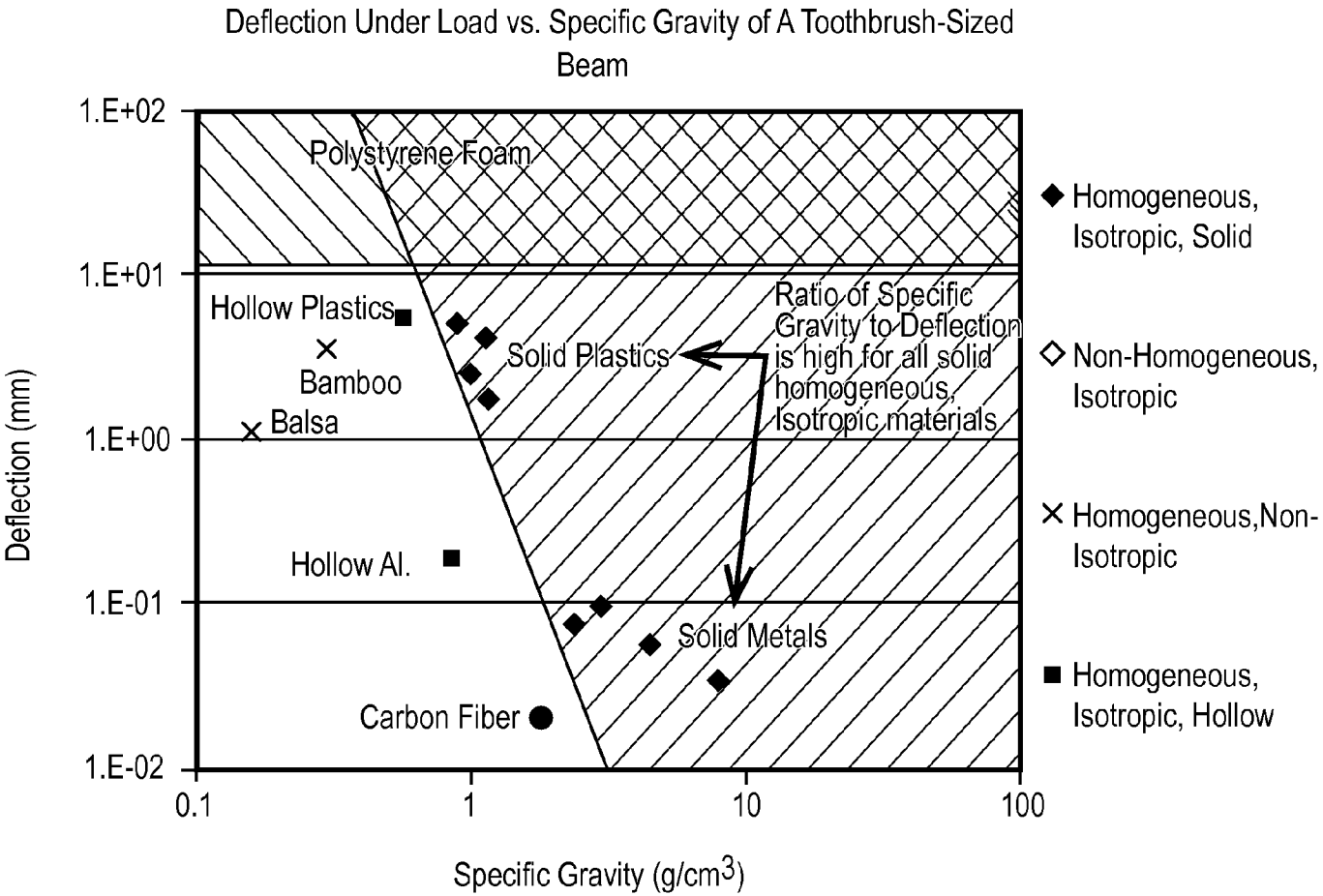
FIG. 9 is a chart illustrating deflection in bending vs. specific gravity.

Materials used to form a unitary toothbrush of present invention having an inner cavity (hollow toothbrushes) should provide a resistance to bending, or stiffness, when a load is applied normal to the longitudinal axis. Toothbrush materials that do not meet this criterion bend severely during normal use, and result in a negative experience or deliver insufficient force to adequately clean teeth. To evaluate candidate materials for construction of a toothbrush in as lightweight an embodiment as possible, we define here a ratio for the bending strength of the handle to its overall specific gravity as a measured deflection under specific loading case described in FIG. 8. The chart in FIG. 9 illustrates this ratio applied to a simple rectangular beam-shaped approximation of solid handles made from isotropic, homogeneous materials; handles made from composite or non-homogeneous, non-isotropic materials; and hollow-handles made from otherwise isotropic, homogeneous materials. Results in the chart are obtained from the analytical equation of bending for the apparatus in FIG. 8 or from the predicted bending in a finite-element analysis of materials not solvable in analytical form, such as anisotropic materials. It is clear from this chart that solid handles made from isotropic, homogeneous materials cannot achieve a bending strength-to-weight ratio achievable by engineered isotropic, homogeneous hollow handles.

Not all hollow, articles have sufficient bending strength to withstand 5N of force applied in bending normal to the major axis at a distance typical of that applied to a toothbrush between a thumb-fulcrum and the brush head. Certainly not all blow molded articles can withstand such forces: many blow molded packages, such as water bottles, must be filled prior to stacking in pallets as their walls are sufficiently thin that they will significantly deform in compression under even the weight of a few empty bottles on top of them. It is possible to make toothbrushes in a similar fashion, either through use of generally weak materials or through manufacture of extreme thinness of walls, such that they would appear strong, possibly due to use of opaque materials or other decoration. Toothbrushes made from these handles would not collapse under gravity or mild forces, and could appear robust in packaging or in a non-use display but in fact would be displeasing or impossible to use as intended, or to deliver sufficient brushing force to maintain oral health. Generally, brushes which deform more than 20 mm under a 5.0N force applied as determined by ASTM D 790 would not be desirable in use. In certain embodiments the unitary toothbrush of the present invention deforms less than about 20 mm under a 5.0N force applied as determined by ASTM D 790. In certain embodiments, the unitary toothbrush of the present invention deforms less than about 10 mm under a 5.0N force applied as determined by ASTM D 790.

Isotropic, non-homogeneous materials appear from this chart to be candidates also for lightweight toothbrushes. However these materials are intrinsically brittle as a result of stress concentrations due to bubbles which are the result of the foaming process. The chart as described above illustrates only predicted or theoretical deflection under load and does not take into account ultimate strength of materials. Toothbrushes made from the foams shown would fracture at the surface under tension while in bending at loads much less than those used during typical brushing.

In general, hollow toothbrush with a substantially-uniform wall thickness provide desired resistance to bending with minimal use of material by placement of the material selectively at the outermost diameter, or the furthest location from the bending axis, where it can bear the most bending moment with the least necessary strength. This selective placement of material naturally reduces the normal stress applied to material elements, caused by the bending moments, and results in less strain per material element per unit of applied normal force or bending moment than if the handle is made from solid material or has material placed primarily in the neutral axis. An I-beam is a common example of selective placement of material as far as possible from a neutral axis. However an I-beam resists bending quite differently when bent around different axes. A hollow part which is substantially round in cross section, such as a hollow toothbrush, will provide adequate strength in bending about a variety of axes, which is necessary for a personal care article such as a toothbrush which is hand held and used regularly in many different orientations and must bear loads about nearly any bending axis.

However, not all hollow toothbrush designs would provide sufficient resistance to bending, as defined in the deflection-to-specific-gravity ratio above. Rather, it is easier to manufacture an extrusion blow molded toothbrush with a very thin, flexible wall than it is to manufacture a toothbrush in such a manner whose wall is thick enough to provide adequate resistance to bending. For all extrusion blow molded articles, there is an upper limit on the thickness of the wall which can be created without creation of significant folds or flash lines in the exterior surface of the article. This upper limit is governed by the smallest outer circumference of the portion of the article which is to be rendered hollow, the starting thickness of the extruded material prior to blowing, and the ratio of the initial circumference of the blown section to the final circumference of the blown section. As the wall thickness of the starting material increases, a greater fraction of it may become trapped between mold surfaces intending to mate, thus creating a flat section around all or a portion of the molded article, commonly known as flash. Hollow toothbrush with even small amounts of flash would be displeasing to use, especially as flash becomes or feels sharper to the touch, the smaller it is.

Elasticity and strength of materials also play a factor in resistance to bending: for example a blow molded toothbrush which is stiff enough and made from a relatively strong material, such as PET-G, may be too weak to be considered useful when molded in the same geometry and wall thickness from LDPE or Polypropylene. Even between LDPE and Polypropylene, a Polypropylene toothbrush may be sufficiently stronger than an LDPE toothbrush such as to be noticeably stiffer by a user.

In certain embodiments of the invention, a polypropylene toothbrush whose length is between 100 mm and 2000 mm, and has a weight between 7.0 g and 13.0 g with material distributed substantially evenly about the wall of the hollow portion, has an overall specific gravity less than 0.5 g/cm$^3$.

In addition to the bending strength, rigidity and convenience in manufacturing a hollow toothbrush is the advantage to using the un-occupied internal volume to house some useful or decorative element. Such elements can include elements common to assembled hollow brushes such as primarily electronic systems, electromechanical systems, primarily mechanical systems, and decorative elements.

Electronic elements such as batteries, timers, alarms, transducers, accelerometers, lights, speakers, amplifiers, resistors, capacitors, inductors, transistors, circuits, circuit boards, printed electronics, electronic ink and substrates, solder, wires, and similar components can be pre-assembled into functioning or partially-functioning systems and installed into the void area in a hollow toothbrush. Such systems can make particular use of undercuts in the hollow portion of the toothbrush, for example by virtue of placement or position against or near an undercut to provide restriction in motion. Such systems may also take advantage of an inner layer of a multi-layer system to provide electrical insulation or conductivity or semi-conductivity between elements integrated to the system, or to elements outside of the toothbrush cavity. An example of this would be an inductive charging system which harvests energy from an external electric field by placement and activation of coils of wire positioned inside of the handle. This is a common method by which power toothbrushes are re-charged when not in use. Specific embodiments of these systems and elements include, but are not limited to: a timer to provide feedback to a user during brushing of the teeth, a force sensor to discourage excessive use of force during brushing, an indicator element informing a user when the expected life of a toothbrush might be reached, lights or sounds to play a song or game during brushing, use of the geometric properties of the hollow void to resonate or attenuate certain sounds generated inside, an electrostatic generator to charge the system to a high or low potential voltage, creation of an 'electronic pet' or tamagotchi, which will thrive if good brushing habits are maintained and suffer or die if they are not, and the like.

Electromechanical systems such as rotating motors, linear motors, permanent-magnet direct current motors, piezoelectric transducers, buttons, toggle switches, temporary switches, magnets, reed switches can also be used independently, or more likely combined with electrical elements and systems to provide further benefits or feedback to users. Examples include but are not limited to: Use of a motor to create a vibrating tactile feedback, use of piezo-transducers or inductive electrical systems to harvest mechanical energy and convert to electrical energy during brushing, use of switches to activate and deactivate electrical or electromechanical systems, use of magnets as elements in inductive systems or to provide detection to an external electrical system, use of strain gauges to measure and feedback or use of vibration-inducing motors or offset-weight motors to create a pleasing tactile sensation at any point in the brush. For the use of mechanical switches, it may also provide an advantage to selectively thin the wall of the toothbrush in some areas but not all in order to create a deformable region which can allow deflection through the solid wall of an internally-mounted switch without creating an orifice which must be sealed in an additional step.

Primarily mechanical systems, such as solids, liquids, gasses, colloids, magnets, living or organic elements, phase-change or chemically-transitioning elements, color-change elements, thermochromatic elements, and the like can be installed within the inner cavity of a hollow unitary toothbrush, either permanently or with the intention of later dispensing, for consumption. Examples of consumable filling elements include but are not limited to: Toothpaste, oral rinse, whitening agents, breath fresheners. Examples of solids include but are not limited to: Articles shaped and designed to add weight or heft to a device, such as iron, zinc, or other metals in solid form; silica, or other granular material, in a single color or multiple colors. Articles made from liquids could include but are not limited to: water, oils, gels, or combinations thereof, including emulsions, mixtures, solutions and combinations of the above which readily separate, such as oil and water. Magnets placed in a device may add advantages of storage or connection/interaction to ferrous materials or articles, for example cabinetry hardware or refrigerator or household appliance doors. Magnets can also be arranged internally so that they interact with magnets outside the toothbrush to stand the toothbrush on end to prevent the head from touching any bathroom or other storage area surfaces. Phase-change or color change elements or systems tuned to slightly below human body temperatures may be included into a hollow toothbrush with transparent outer layers for example to create a non-electric timer, which would permit the toothbrush to change color after sufficient time held in the hand.

Separate from installed elements, and an advantage of a unitary toothbrush with inner cavity is the ability to decorate a translucent or transparent toothbrush on an inner surface which is isolated from contact by the user via the body of the toothbrush. In these embodiments, there would be an advantage in isolating the decorative layer from human contact, for example to create some delay in the temperature elevation of the isolated layer, i.e. for thermochromatic paint which may change color after approximately some set time. Also advantageous would be a reduction in the appearance of wear, in contrast to surfaces which are painted or decaled on the outside surface and subject to mechanical wear and chemical attack.

EXAMPLES

Example 1

Table 1 shows that the walls of toothbrushes of the present invention having an inner cavity have minimal deviation in thickness along the length of a toothbrush: wherein (1) the wall thickness of the hollow portion of the unitary toothbrush, is determined by the shortest distance between the outer surface of the toothbrush and the inner cavity surface at the point of measurement; (2) the average wall thickness is the average of all measured thickness along the circumferential direction of the cross-section at a chosen point; (3) the toothbrush average wall thickness at the inner cavity portion is the average of the thickness of each cross-section; (4) the air void percentage.

TABLE 1

| | Sample 1 | Sample 2 | Sample 3 |
|---|---|---|---|
| ave wall thickness (mm) | 1.0 | 1.8 | 1.4 |
| max thickness (mm) | 2.4 | 3.4 | 2.6 |
| min wall thickness (mm) | 0.60 | 0.9 | 0.3 |
| std wall thickness (mm) | 0.2 | 0.4 | 0.2 |
| std/average (mm) | 25.3% | 23.9% | 13.8% |
| Air void percentage | 66% | 44.6% | 61.5% |

As shown in Sample 1, the wall thickness of the hollow portion of the unitary toothbrush can be evenly distributed and can be as thin as about 0.6 mm, with an average wall thickness of the hollow portion of the toothbrush of 1.0 mm and a standard deviation in wall thickness of about 0.25 mm, which is only about 25.3% of the average thickness—illustrating only a minor deviation in wall thickness. Sample 2 shows the wall thickness of the hollow portion ranges from about 1.8 to about 3.4 mm, with a standard deviation of the wall thickness of about 0.44 mm, which is only about 23.4% of the average thickness of 1.8 mm. Sample 3, shows the wall thickness of the hollow portion ranges from 0.3 mm to 2.6 mm, with a standard deviation of 0.2 mm, which is only about 13.8% of the average thickness of 1.4. The above results show that the toothbrush walls of the present invention have minimal deviation in thickness along the length of the toothbrush.

Example 2

To determine if the unitary toothbrush of present invention with an inner cavity has uniform wall thickness along the circumferential direction of each cross-section a toothbrush sample was first micro-scanned and then about 1000 wall thickness measurements within every 2-mm-long section in 80% of the hollow portion along the longitudinal axis of the micro-CT scan are taken and the statistics are calculated. The mean thickness within each 2-mm section of the toothbrush was also calculated along the longitudinal axis of the toothbrush. The toothbrush samples with inner cavity have significant undercut and contour. The cross-section of the toothbrush with inner cavity is not circular but more like a rounded triangular shape. The wall thickness of the toothbrush along either longitudinal or axial direction is more of a continuous function. The curvature and shape of the inner cavity can follow the curvature and shape of the outer surface at any cross-section of the toothbrush. There would be no abrupt change of wall thickness from one point to another point next to it. The wall thickness change from one point to another neighboring point is less than 1 mm or even less than 0.5 mm.

Example 2A

Figure 5A:
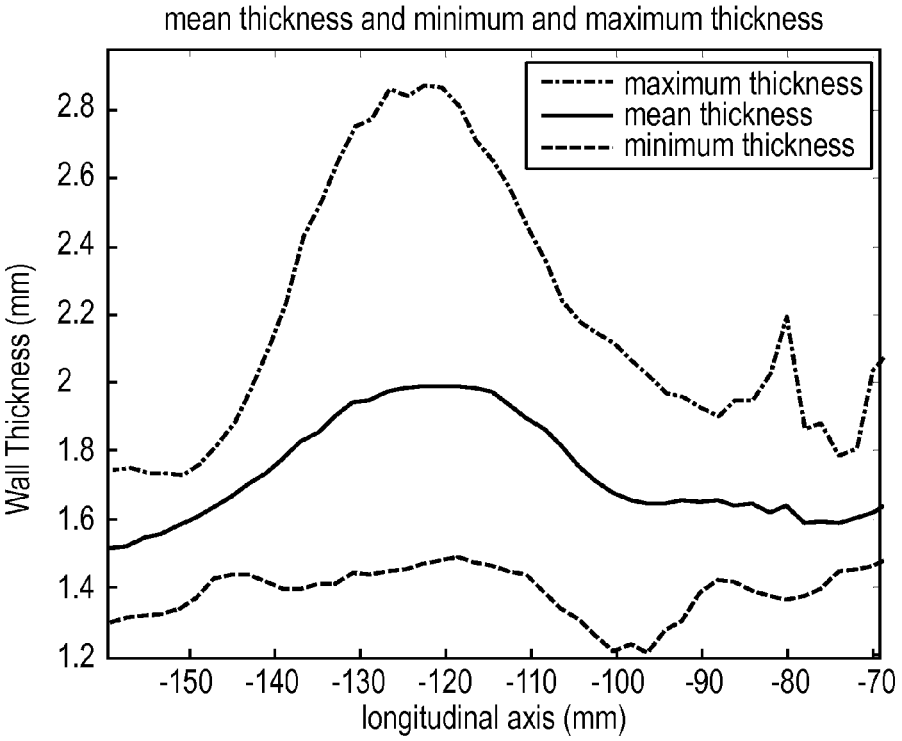
FIG. 5A is a chart showing the variation of mean, minimum and maximum wall thickness of any 2-mm section of the toothbrush along the longitudinal axis of one embodiment with a thick handle.
Figure 5B:
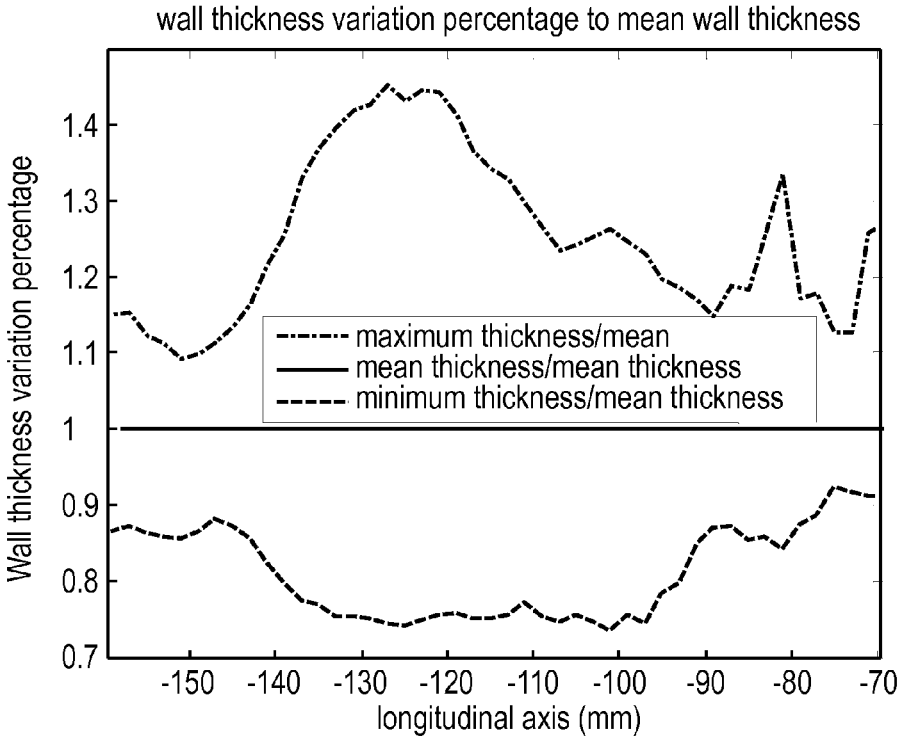
FIG. 5B is a chart showing minimum and maximum wall thickness percentage of the mean wall thickness of any 2-mm section of the toothbrush along the longitudinal axis of one embodiment with a thick handle.

In one sample of the toothbrush with a thick handle, the wall thickness in each 2-mm-long section varies within 70% to 170% of the mean wall thickness of the same 2-mm section, as shown in FIG. 5B. The absolute wall thickness varies from 0.6 mm to 2.3 mm in 80% of the hollow portion of the toothbrush as shown in FIG. 5A. The mean wall thickness of each 2-mm section along the longitudinal axis of the toothbrush is in the range of 0.9 mm to 1.2 mm. These are really small variations in the wall thickness. The ratio of standard deviation of wall thickness to mean wall thickness is less than 30%. The cross-sectional area of this toothbrush sample remains constant at about 45 $mm^2$ in 80% of the hollow portion of the toothbrush. The wall thickness change from one point to another neighboring point is less than 0.5 mm. In contrast, the cross-sectional area of a solid toothbrush with the same outer surface varies greatly from 120 $mm^2$ to 210 $mm^2$ in the same handle portion. This hollow toothbrush with a thin handle saves 66% of material from a solid toothbrush with the shape and size.

Example 2B

Figure 6A:
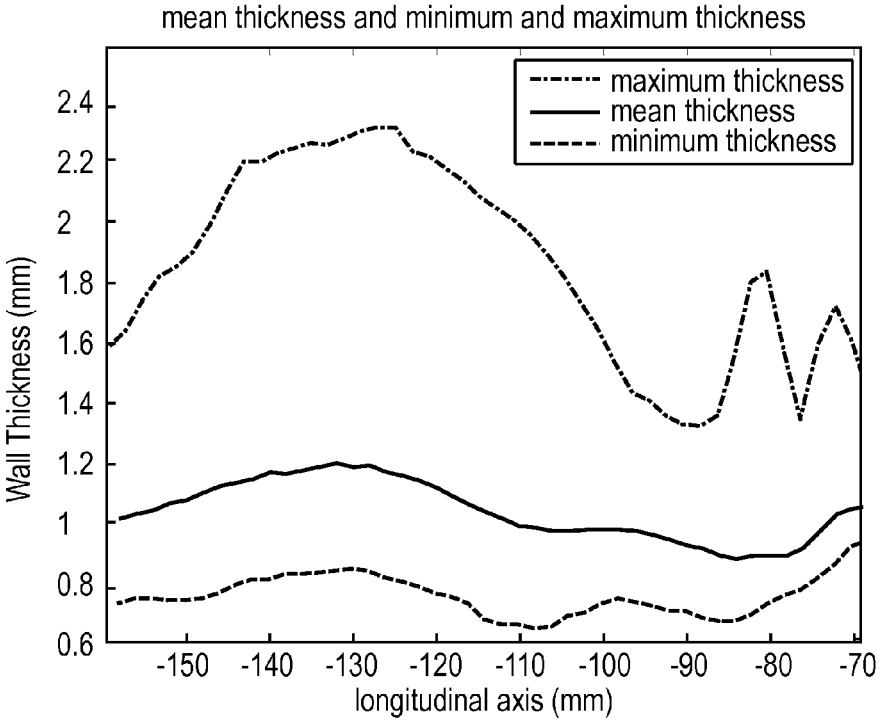
FIG. 6A is a chart showing the variation of mean, minimum and maximum wall thickness of any 2-mm section of the toothbrush along the longitudinal axis of another embodiment with a thin handle.
Figure 6B:
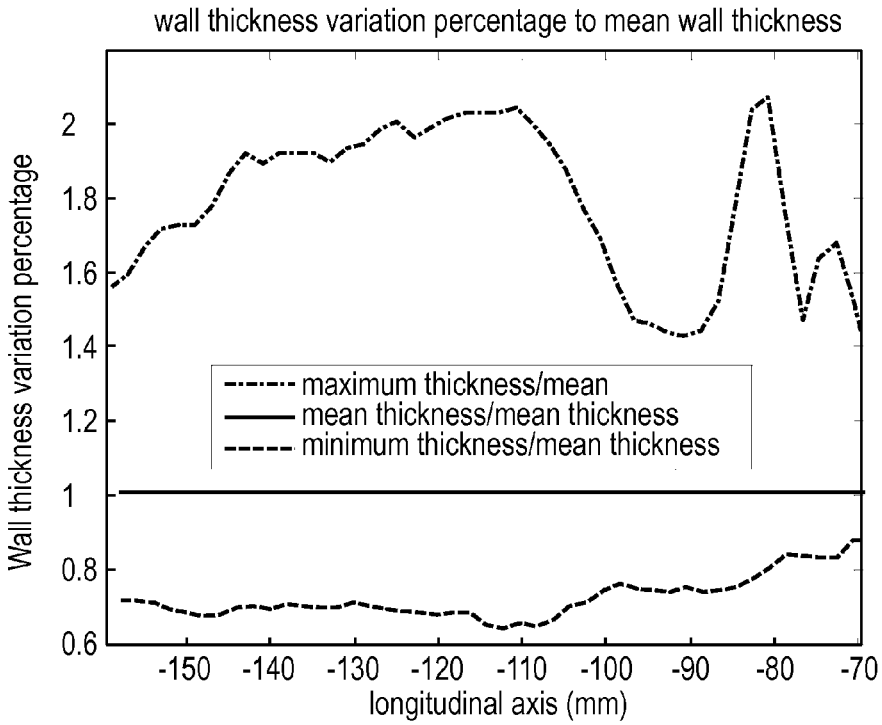
FIG. 6B is a chart showing minimum and maximum wall thickness percentage of the mean wall thickness of any 2-mm section of the toothbrush along the longitudinal axis of another embodiment with a thin handle.

In another sample of the toothbrush with a thin handle, the wall thickness in each 2-mm section varies within 65% to 180% of the mean wall thickness of that 2-mm section, as shown in FIG. 6B. While the absolute wall thickness varies from 1.2 mm to 2.8 mm, as shown in FIG. 6A. The mean wall thickness of each 2-mm section along the longitudinal axis of the toothbrush is in the range of within 1.5 mm to 2 mm. The ratio of standard deviation of wall thickness to mean wall thickness is less than 23%. The cross-sectional area of this toothbrush sample remains constant at about 70 $mm^2$ in 80% of the hollow portion of the toothbrush as shown in FIG. 6. In contrast, the cross-sectional area of a solid toothbrush with the same outer surface varies greatly from 120 $mm^2$ to 210 $mm^2$ in the same handle portion. This hollow toothbrush with a thin handle saves 47% of material from a solid toothbrush with the shape and size.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A toothbrush comprising:

a. a head, neck, handle, handle end, head end, outer surface, inner cavity, and longitudinal axis;

b. the inner cavity having a surface defining a cross-sectional area; wherein the inner cavity has at least one of a greater cross-sectional area, bordered by two lesser cross-sectional areas along the longitudinal axis of the toothbrush or a lesser cross sectional area bordered by two greater cross-sectional areas along the longitudinal axis of the toothbrush;

c. the outer surface defining an outer surface cross-sectional area;

d. a wall formed from the outer surface and inner cavity surface having a thickness;

wherein the toothbrush comprises a single unitary component along the entire longitudinal axis;

wherein a wall thickness along a circumferential direction at any cross-section normal to the longitudinal axis in 80% of the inner cavity is within 70% to 170% of a mean wall thickness;

wherein the toothbrush has a specific gravity below about 0.50 g/cm$^3$ and wherein the toothbrush deforms less than about 10 mm under a 5.0N force applied as determined by ASTM D 790.

2. The toothbrush of claim 1, wherein a square root of outer surface cross-sectional area varies proportionally to a square root of the inner cavity cross-sectional area along the longitudinal axis of the toothbrush.

3. The toothbrush of claim 1, wherein a total volume of the inner cavity is about 50% to 70% of a total volume defined by the outer surface.

4. The toothbrush of claim 1, wherein at least one of the ends of the toothbrush along the longitudinal axis has a smaller outer surface cross-sectional area than a maximum cross-sectional area of the inner cavity.

5. The toothbrush of claim 4, wherein the toothbrush handle end has a smaller outer surface cross-sectional area than the maximum cross-sectional area of the inner cavity.

6. The toothbrush of claim 1, wherein at least one of the ends of the toothbrush along the longitudinal axis has a smaller outer surface cross-sectional area than a minimum cross-sectional area of the inner cavity.

7. The toothbrush of claim 6, wherein the toothbrush handle end has a smaller outer surface cross-sectional area than the minimum cross-sectional area of the inner cavity.

8. The toothbrush of claim 1, wherein the toothbrush comprises at least one of polypropylene, polyethylene terapthalate, polyethylene terapthalate glycol, high-density polyethylene, low-density polyethylene, or polystyrene.

9. A toothbrush comprising:

e. a head, neck, handle, handle end, head end, outer surface, inner cavity, and longitudinal axis;

f. the inner cavity having a surface defining a cross-sectional area; wherein the inner cavity has at least one of a greater cross-sectional area, bordered by two lesser cross-sectional areas along the longitudinal axis of the toothbrush or a lesser cross sectional area bordered by two greater cross-sectional areas along the longitudinal axis of the toothbrush;

g. the outer surface defining an outer surface cross-sectional area;

h. a wall formed from the outer surface and inner cavity surface having a thickness;

wherein the toothbrush comprises a single unitary component along the entire longitudinal axis;

wherein a standard deviation of the wall thickness does not exceed 30% of a mean wall thickness across 80% of the inner cavity;

wherein the toothbrush has a specific gravity below about 0.50 g/cm$^3$ and wherein the toothbrush deforms less than about 10 mm under a 5.0N force applied as determined by ASTM D 790.

10. A toothbrush comprising:

a. a head, neck, handle, handle end, head end, outer surface, inner cavity, and longitudinal axis;

b. the inner cavity having a surface defining a cross-sectional area; wherein the inner cavity has at least one of a greater cross-sectional area, bordered by two lesser cross-sectional areas along the longitudinal axis of the toothbrush or a lesser cross sectional area bordered by two greater cross-sectional areas along the longitudinal axis of the toothbrush;

c. the outer surface defining an outer surface cross-sectional area;

d. a wall formed from the outer surface and inner cavity surface having a thickness;

wherein the toothbrush comprises a single unitary component along the entire longitudinal axis;

wherein a ratio of the mean radius to wall thickness in 80% of the inner cavity is in a range of 3 to 10;

wherein the toothbrush has a specific gravity below about 0.50 g/cm$^3$ and wherein the toothbrush deforms less than about 10 mm under a 5.0N force applied as determined by ASTM D 790.

* * * * *